United States Patent [19]

Job

[11] 4,167,974

[45] Sep. 18, 1979

[54] SPRINKLER

[76] Inventor: Eduard J. Job, Schimmelmannstrasse 25, 2070 Ahrensburg, Fed. Rep. of Germany

[21] Appl. No.: 825,915

[22] Filed: Aug. 19, 1977

[30] Foreign Application Priority Data

Sep. 1, 1976 [DE] Fed. Rep. of Germany ..... 2639245

[51] Int. Cl.[2] ..... A62C 37/08

[52] U.S. Cl. ..... 169/38

[58] Field of Search ..... 169/37, 41

[56] References Cited

U.S. PATENT DOCUMENTS

| | | | |
|---|---|---|---|
| 489,342 | 1/1893 | Stratton | 169/41 |
| 585,130 | 6/1897 | Steck | 169/39 |
| 891,279 | 6/1908 | Martin | 169/39 |
| 1,797,919 | 3/1931 | Loepsinger | 169/38 |

FOREIGN PATENT DOCUMENTS

| | | | |
|---|---|---|---|
| 1350991 | 4/1974 | United Kingdom | 169/41 |

*Primary Examiner*—John J. Love

*Attorney, Agent, or Firm*—H. Dale Palmatier

[57] ABSTRACT

A sprinkler having a valve disc closed by pressure sealing. The valve disc corresponds to a spring elastic annular disc which is subject to uniform loading of acting hydraulic forces and to annular loading of sealing forces of the valve seating on one side, and is supported substantially and centrally at the support surface by a support on the other side. The differential spring rate for annular loading under deflection is smaller or equal to the spring rate of the support measured from the support face to the valve seating.

21 Claims, 5 Drawing Figures

SPRINKLER

BACKGROUND OF THE INVENTION

1. Field of the Invention

This invention relates to a sprinkler, which is closed by means of a valve disc by pressure sealing.

2. Description of the Prior Art

Sprinklers must remain tight against varying water pressures over decades, under varying atmospheric and thermal conditions, but must open without sticking as soon as they are triggered. The usually thermal triggering devices must respond as sensitively and reliably as possible.

The majority of conventional sprinkler designs with pressure sealing make use of a relatively stiff valve disc, which is pressed down by a resilient support onto a rigid valve seating. The resilient support includes the trigger member and some intermediate members, which together constitute the thermal trigger, and also includes the sprinkler body. While a certain spring property is necessary, in order to compensate for the influence of the differing temperature strain and bedding down of the individual components during decades of continuous use, the exact location of the spring in the support has varied considerably. In some prior sprinkler heads, the resiliency, or spring, is obtained in the sprinkler body which is integral with the valve seat, and in other sprinkler heads, the resiliency is obtained in parts related to the thermal trigger. Where glass bulbs are used as the trigger member, with their very different temperature expansion by comparison with metals, a special spring packet is usually also required. Such prior art provides for the resiliency at locations away from the actual closure which traverses the valve seat.

Pressure seals are simple in construction and impose relatively easy demands upon the sealing material by comparison with self-sealing chamber seals, for example comprising O-rings, which in addition demand permanently elastic properties of the material.

The strength of thermal trigger members in sprinklers should be designed essentially according to the expected permanent load, which may be carried for many years, since the permissible endurance strength of the usual trigger members with eutectic solders or glass bulbs amounts to only a small portion of their short-term load-bearing capacity.

In said prior art sprinkler designs, which provide for the necessary resiliency at a location away from the closure which traverses the valve opening, and which in their sealing action are comparable to a spring-loaded safety valve, the load applied to the support and thus to the trigger member at operating pressure (up to 12.5 bars) is as high as at the maximum test pressure (up to more than 60 bars), that is the leakage pressure at which the valve disc commences to lift as a whole. In other words, there is no relief or reduction in pressures carried by the support and thermal trigger under normal operating conditions as compared to the conditions to resist extreme test or leak pressures which will be encountered only momentarily or for short periods. The permanent load corresponds to the maximum occurring force, and especially as a result powerful and thus heavy or complicated triggering devices are necessary.

With other sprinkler designs with chamber seals it is possible, as a result of the self-sealing action, to reduce the permanent load considerably by comparison with the loading at maximum test pressure. Nevertheless, permanently elastic materials are necessary, which hitherto have not satisfied all the requirements throughout the entire operating range of the sprinkler.

Another form of construction (German Patent No. 1,258,278) achieves a reduced permanent load by utilising a resilient valve seating projecting in the form of a collar, and additionally compressed by the hydraulic forces. This form of construction, however, is complicated and expensive to manufacture.

SUMMARY OF THE INVENTION

An object of the present invention is, in a sprinkler having the very advantageous pressure sealing, to reduce the permanent load on the triggering device while retaining simplicity of construction.

This problem is solved according to the present invention by the fact that the valve disc, at least in an annular section, corresponds to a spring-elastic or resiliently flexible disc, which is subjected on the one side to the uniform load of the acting hydraulic forces and to the annular load of the sealing forces of the valve seat, and is supported on the other side substantially centrally by a support, whereby the differential spring rate for annular loading under deflection in the assembled state is smaller than or equal to the spring rate of the support, measured from the valve seat. More specifically, the body of the sprinkler head, taken together with the thermal trigger, are considered substantially rigid, although they may have limited yieldability to flex; however, compared to the body and trigger, the valve disc is considerably more flexible. The magnitude of deflection in the disc, per unit of loading, will be significantly greater than in the body and trigger. Furthermore, with load applied at the center of the disc at the obverse side thereof, and opposing load applied at the reverse side of the disc, there is significantly less flexing of the disc caused by applying said opposing load uniformly across the reverse side of the disc, than by applying the opposing load to the reverse side of the disc only at the outer periphery thereof.

To asist in an understanding of the method of action, the valve will be compared with an elastic disc, supported in the centre at the obverse side by a support. To obtain a given deflection of the edge, a greater total load at the reverse side of the disc is required with uniform distribution of the load than if the load applied to the reverse side of the disc is applied only at the peripheral edge. This means that the disc is stiffer as a spring when loaded uniformly at one face than when loaded only at the outer periphery or rim. It may be said that the spring rate with respect to uniform loading is greater than that with respect to annular or rim loading. At leakage pressure (up to more than 60 bars), when the valve disc lifts at the edge, the principal load tending to lift the valve element to cause leaking is a uniformly distributed load applied by the hydraulic fluid. This pressure at which leakage occurs is the same as in the use of rigid valve elements. Such leakage pressures must be accommodated only momentarily, or for short periods, whereas the operating pressures must be accommodated for years. At the much lower operating pressure (up to 12.5 bars), the sealing forces exerted in an annular pattern by the valve seat are basically governing the deflection, while the influence of the hydraulic forces is small.

With the arrangement according to the present invention, wherein the sprinkler head utilizes a resilient valve disc, the deflection of the edge of the valve disc remains practically unaltered on account of the relatively stiff support including the thermal trigger and valve seat, but the force which the support has to accept from the flexed valve disc and the hydraulic pressure is therefore smaller under operating pressure than under leakage pressure, on account of the lower spring rate in the former. The permanent load which determines the strength of the trigger member is thus less in the present invention which utilizes a spring valve disc and a substantially rigid support than with the prior art sprinklers which make use of a stiff valve disc and a resilient support. The trigger members in the present invention can be constructed lighter and thus with less inertia. The construction of the arrangement according to the present invention is uncomplicated, while the attainable, larger spring travels favour a simple and reliable assembly; additional spring packages, for example for glass bulbs, can be omitted.

By suitable shaping of the resilient valve disc, it is moreover possible to give to the spring characteristic in the working range a flatter shape, whereby the differential spring rate in this range can tend towards zero. Thus, even if the individual components bed down during years of continuous use and drastic temperature fluctuations occur, a virtually constant load is guaranteed. The triggering devices and sprinkler bodies no longer need to be constructed to be resilient, which affords a greater degree of freedom in the design and detailing of these components and simplifies them.

The valve disc of the sprinkler according to the present invention can be of various shapes for reasons of ease in manufacture and in order to influence the spring characteristic in differing ways, but should be sufficiently resilient at least in an annular section. If one portion is stiffened, then the other parts should be formed correspondingly more elastic. Stiffeners in the centre of the valve disc or corresponding apertures with inserts which have a similar stiffening action, change the ratio of the spring rate for annular loading to the spring rate for uniform loading and thus the ratio of permanent load to loading at leakage pressure. Depending upon the proportion (F) of the stiffened or cut-out area to the total area of the valve disc, starting from F equal to zero for continuous discs without stiffening, the permanent loading on the support during normal operating pressures varies considerably in relation to the loading applied under high leakage pressures, as the proportion of stiffened area in the resilient disc is changed. For instance, the permanent loading (Lp) at normal operating pressure relates to the loading (L) at leakage pressure, as follows: for F equal to 0, Lp is about $\frac{2}{3}$ L; for F equal to $\frac{1}{3}$ Lp is about $\frac{1}{2}$ L; and for F equal to $\frac{2}{3}$ Lp is about $\frac{5}{8}$ L.

BRIEF DESCRIPTION OF THE DRAWINGS

The invention is explained in more detail below with reference to the drawing, in which some examples of embodiment thereof are illustrated. The drawing shows.

DESCRIPTION OF PREFERRED EMBODIMENTS

FIGS. 1 to 5 also illustrate pressure seals with different seal linings, which can be utilised in various combinations with the most varied valve discs. With pressure seals, the frequently inserted seal lining has the function of compensating surface irregularities and roughness of the sealing gap. The seal lining, which for example may be used as a loose washer or ring or as a coating, consists of relatively soft, enduring, non-sticking material which deforms to the pressing faces, such for example as soft copper or polytetrafluorethylene. A special seal lining may however be completely omitted, if the surface quality of the sealing faces is suitable.

Figure 1:
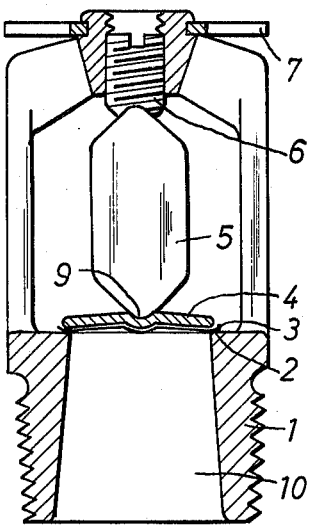
FIG. 1 a section through a sprinkler according to this invention comprising a valve disc which is formed as an approximately flat disc.

The sprinkler illustrated in FIG. 1 comprises a sprinkler body 1 with valve opening 10 and valve seating 2. The valve opening 10 is closed by a resilient valve disc 4 with seal lining 3, by pressure sealing. The valve disc 4 is supported on the support surface 9 by a triggering device 5, a clamping screw 6 and the sprinkler body 1, which together constitute the support 1 - 5 - 6. In the case of fire, the triggering device 5 reacts and releases the valve disc 4, causing fire extinguishing water to flow out of the valve opening 10 and to be distributed by the deflector 7 over the area of the fire. In the form of construction according to this invention, the support 1 - 5 - 6 should be stiffer than the resilient valve disc 4. The stiffness or spring rate of the support 1 - 5 - 6, measured from the valve seating 2 to the support face 9, should be at least equal to, but preferably greater than the differential spring rate of the valve disc 4 under annular loading in the assembled state.

The valve disc 4 in FIG. 1 consists of an approximately flat disc of uniform thickness without special stiffening. The seal lining 3 is shown here as a continuous, pliant washer, which causes the hydraulic forces to act unimpeded upon the valve disc 4.

Figure 2:
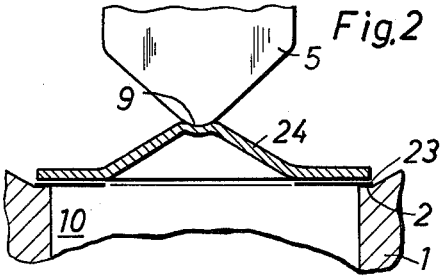
FIG. 2 a detail of FIG. 1 comprising a valve disc which is deformed in the centre to stiffen it.

FIG. 2 shows a valve disc 24 with a stiffened central portion, obtained by a conically deformed and thus form-stable portion of a resilient disc of approximately uniform thickness. Similar valve discs comprising a form-stable portion can be made in many forms, for example convex or concave, conical or domed, by pressing, drawing or punching. The seal lining 23 is shown as a perforated washer, which is loosely inserted or is bonded to the valve disc.

Figure 3:
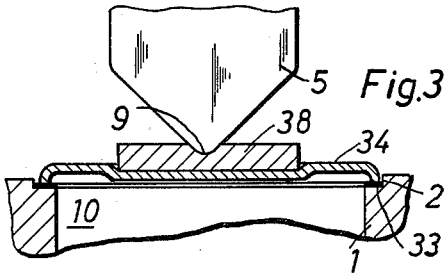
FIG. 3 a detail of FIG. 1 comprising a valve disc having a component behind it to stiffen it.

In FIG. 3, a stiffening or stiff round wafer or slug 38 is placed behind the resilient valve disc 34 for the purpose of stiffening it, the diameter of this component determining in a simple manner the stiffened area. The component 38 does not need to be an independent part, but can also be a constituent part of the triggering device 5. In FIG. 3, moreover, the possibility of deforming the external edge of the valve disc 38 is illustrated, resulting in sharper sealing edges for the pressure seal. At the same time, the spring characteristic can thereby be given a flatter shape in the working range. The seal lining 33 is illustrated as a narrow ring applied onto the valve seating 2.

Figure 4:
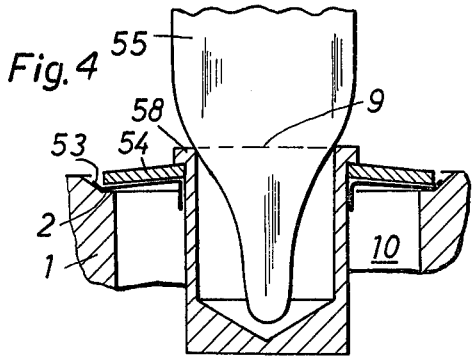
FIG. 4 a detail of FIG. 1 with a glass bulb as the triggering device and a valve disc which is constructed as an annular spring element with insert.

The valve disc in FIG. 4 consists of an approximately flat, annular spring element 54, for example a commercially available cup spring, and of a fitting insert 58, and also a seal lining 53 which can be so shaped that it simultaneously seals the external and internal edges of the spring element 54. The insert 58 can be of various forms, for example as a turned, drawn or injection moulded component, with or without stiffening and shaped for the purpose of receiving the triggering device and may be secured and sealed such as by pressing in, rabetting or bonding to the inner edge of the spring element 54.

Figure 5:
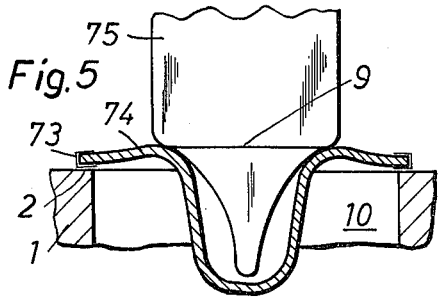
FIG. 5 a detail of FIG. 1 with a glass bulb as triggering device and a valve disc which is constructed as a formed spring element with a depression for the purpose of receiving the glass bulb.

The forms of embodiment according to FIGS. 5 and 7 are suitable especially for receiving various types of glass bulb 55, 75 as the trigger members.

The valve disc 74 of FIG. 5 is obtained from the spring element 64, if the drawn-in inner edge is formed to a closed basin, causing the second seal on the inner side to be omitted. The seal lining 73 is illustrated as a coating of the external edge of the valve disc.

The resilient valve discs in FIGS. 1 to 5 should be of a material which retains its spring-elastic properties through decades of continuous operation. Attention should also be given to the wide temperature range of use for the sprinkler. The material must be corrosion-resistant, if it is not to be protected in some other manner, for example by coating.

The resilient elements can be punched and formed directly from already spring-hard material, where the degree of deformation is small, for example the component 4, component 54 and also component 34. For medium to high degrees of deformation, for example the component 24, component 64 and component 74, spring materials are to be recommended which can be hardened by the pressing and drawing operation itself or even after shaping.

The sprinkler shown in FIG. 1 represent only one of the many various forms of embodiment of sprinklers according to the present invention having a resilient valve disc and a relatively stiff support. For example, depending upon the desired water distribution and method of installation of the sprinkler, the deflector 7 may be of various shapes. For the triggering devices 5, 55 or 75, practically all the forms of construction known in sprinklers, such as the various lever systems locked by fusible links, or glass bulbs may be suitable.

The sprinkler body 1 can be of the most varied shape, for example it may consist of one or more parts, or have a different number of arms and a directly integrally formed deflector, with or without clamping screw or with other stressing elements. The invention can with advantage also be used for sprinkler designs, in which a deflector recessed into the ceiling does not jump out until a fire occurs, or also in so-called suspended dry sprinklers, in which the valve disc is supported by a fairly long linkage.

I claim:

1. A valved sprinkler head for connection to a source of hydraulic fluid under pressure, comprising substantially rigid means defining a sprinkler body having a valve opening and a broad annular substantially flat surface around the periphery of the valve opening and defining an annular valve seat, the rigid means also including a thermal trigger, and the rigid means confronting the valve opening centrally of the valve seat, a stiff and resiliently flexible valve disc traversing the valve opening to directly receive the force of the hydraulic fluid pressure in the valve opening, and the valve disc having its periphery engaging and sealing against the valve seat under significant pressure, and the periphery of the valve disc being capable of radially expanding at the outer surface of the annular valve seat, the valve disc having a central portion confronting and engaging said rigid means under pressure, the force applied by the rigid means at the central portion of the valve disc causing continued resilient flexing and deformation of the disc between the central portion of the disc and the periphery thereof and the force also opposing the uniform pressure of the hydraulic fluid in the valve opening.

2. The sprinkler head according to claim 1 wherein said valve disc is approximately flat and of generally uniform thickness.

3. The sprinkler head according to claim 1 wherein the central portion of said valve disc is stiffened by deformation.

4. The sprinkler head according to claim 1 and including means stiffening the central portion of the disc.

5. The sprinkler head according to claim 1 wherein said valve disc is annular and has a central opening, and the rigid means traversing said central opening and including an annular sealing face engaging and sealing against the inner periphery of the annular valve disc.

6. The sprinkler head according to claim 5 wherein said rigid means includes an insert traversing the central opening of the annular valve disc and seals against the inner periphery of the disc.

7. The sprinkler head according to claim 1 wherein said valve disc comprises a resilient material which can harden after deformation.

8. The sprinkler head according to claim 7 wherein said material which can harden after deformation is beryllium-nickel.

9. The sprinkler head according to claim 3 and a seal lining in the form of a pliant washer lying against the disc and facing the valve opening.

10. The sprinkler head according to claim 9 wherein said seal lining entirely traverses the valve opening and the side of the valve disc to provide a protection against corrosion.

11. The sprinkler head according to claim 1 and including a gasket-like seal between said valve seat and said valve disc.

12. The sprinkler head according to claim 3 wherein the deformation obtains a central opening in the disc and traversed by said rigid means.

13. The sprinkler head according to claim 3 wherein the central portion of the valve disc has a frustum shape for stiffening against flexing.

14. The sprinkler head according to claim 3 wherein the valve disc has a generally flat outer peripheral portion and the central portion having an annular inner periphery oriented transversely of the flat outer peripheral portion for stiffening the central portion against flexing.

15. The sprinkler head according to claim 3 wherein said valve disc has a generally flat outer peripheral portion and the central portion being deformed with annular portions lying transversely of said outer peripheral portions of the valve disc.

16. The sprinkler head according to claim 4 wherein the rigid means includes a stiffening element lying flush against the central portion of the valve disc to reduce flexing of the central portion of the valve disc.

17. The sprinkler head according to claim 6 wherein the insert is cup-shaped with an annular flange defining said sealing face, the thermal trigger engaging and applying force against the upper periphery of the cup-shaped insert.

18. The sprinkler head according to claim 17 and the thermal trigger having a tip end extending into the cup-shaped insert.

19. A valved sprinkler head for connection to a source of hydraulic fluid under pressure, comprising a substantially rigid support means including a sprinkler body having a valve opening for the hydraulic fluid under pressure and an annular valve seat around the periphery of the valve opening, the support means including releasable retainer means confronting the valve opening centrally of the valve seat, the retainer means including a thermal trigger, and a stiff and resiliently flexible valve disc traversing the valve opening to directly receive the force of the hydraulic fluid pressure in the valve opening, and the valve disc having its outer periphery engaging and sealing against the valve seat under significant pressure, and the periphery of the valve disc being capable of radially expanding at the outer surface of the annular valve seat and the valve disc having central portion confronting and engaging the releasable retainer means under pressure, the valve disc being flexed under the force applied by the retainer means.

20. The valved sprinkler head according to claim 19 wherein said valve disc is more flexible and less stiff than the support means under the force of the pressure exerted on the disc by the retainer means.

21. The valved sprinkler head according to claim 19 and the valve seat having free and unobstructed space adjacent the outer periphery of the valve disc.

* * * * *